United States Patent [19]

Bassinger

[11] 4,171,025

[45] Oct. 16, 1979

[54] HYDRAULIC SHOCK ABSORBING METHOD

[75] Inventor: Grey Bassinger, Midland, Tex.

[73] Assignee: Technical Drilling Tools, Inc., Houston, Tex.

[21] Appl. No.: 860,568

[22] Filed: Dec. 14, 1977

Related U.S. Application Data

[63] Continuation-in-part of Ser. No. 729,194, Oct. 4, 1976, Pat. No. 4,067,405.

[51] Int. Cl.[2] ..... E21C 7/06

[52] U.S. Cl. ..... 175/65; 175/321; 267/125

[58] Field of Search ..... 175/65-72, 175/296, 293, 321, 322; 64/23; 267/125; 173/102, 103

[56] References Cited

U.S. PATENT DOCUMENTS

| | | | |
|---|---|---|---|
| 1,785,559 | 12/1930 | Ponti | 175/321 |
| 2,661,928 | 12/1953 | Topanelian, Jr. | 175/296 X |
| 2,712,435 | 7/1955 | Allen | 175/321 X |
| 2,851,251 | 9/1958 | Mori | 173/102 X |
| 2,901,221 | 8/1959 | Whittle | 175/94 |
| 2,937,007 | 5/1960 | Whittle | 175/94 |
| 2,946,314 | 7/1960 | Nast | 173/102 |
| 3,834,472 | 9/1974 | Perkins | 175/321 |
| 4,055,338 | 10/1977 | Dyer | 64/23 |

FOREIGN PATENT DOCUMENTS

| | | | |
|---|---|---|---|
| 1405898 | 6/1965 | France | 175/321 |

*Primary Examiner*—Ernest R. Purser
*Assistant Examiner*—Richard E. Favreau
*Attorney, Agent, or Firm*—Cox, Smith, Smith, Hale & Guenther Incorporated

[57] ABSTRACT

A hydraulic shock absorbing method for protecting the drill bit and drill pipe in rotary earth drilling comprising the steps of slidably moving an anvil connected to a drilling bit in a casing in response to increased down weight on the drill bit and sequentially transmitting further increases in the down weight and shocks from the anvil to a plurality of independently operating hydraulic pistons slidably mounted within the casing when down weight on the drill bit exceeds increasing predetermined amounts to activate the pistons in sequence. The drilling fluid within the casing is transmitted to first pressure areas on the anvil and the plurality of pistons and the drilling fluid is passed through the drilling bit to provide a pressure drop and then communicated to second pressure areas on the plurality of pistons.

9 Claims, 7 Drawing Figures

HYDRAULIC SHOCK ABSORBING METHOD

This application is a continuation-in-part of application Ser. No. 729,194 filed Oct. 4, 1976, entitled "Hydraulic Shock Absorber", now U.S. Pat. No. 4,067,405, issued Jan. 10, 1978.

BACKGROUND OF THE INVENTION

This invention relates to shock absorbers and, more particularly, to a hydraulic shock absorbing method for use in protecting the drill bit and drill string from shocks produced by the vibrational energy developed in rotary drilling through rough and broken formations.

BRIEF DESCRIPTION OF THE PRIOR ART

Many different types of shock absorbers have been designed for use in rotary drilling operations. Most of the prior devices have a trapped gas located inside a variable volume container. By reducing the volume of the container with upward movement of a lower component through a lower sub, the trapped gas is compressed thereby increasing the resistance to the upward movement within a telescoping component. Likewise, when the lower component moves downward from the telescoping component, the volume of the trapped gas increases thereby offering less resistance to upward movement within the telescoping component. The movement within the telescoping component is normally initiated by forces on the drilling bit.

Other types of shock absorbers used in rotary drilling include an elastomeric substance located between telescoping elements of the shock absorber. The elastomeric substance is unsuitable in high temperature and certain chemical environments and life is relatively short for this type of device.

Still another type of shock absorbing device is disclosed in U.S. Pat. No. 3,382,936 and consists of an air bag filled with pressurized air with the volume of the air bag being changed in response to telescoping movement of the lower element inside a casing. The problem with using a pressurized bag of air in a shock absorber becomes apparent when the downweight on the drilling bit is substantially varied. Since the shock absorber must be preset with a predetermined air pressure for a given drilling condition, when drilling conditions change the shock absorber will be considerably less effective.

SUMMARY OF THE INVENTION

The present invention is directed to a hydraulic shock absorbing method using an upper sub connected to the upper end of a casing enclosing a plurality of axially aligned hollow pistons slidably mounted therein, the casing being connected at its lower end to a lower sub enclosing an anvil slidably mounted therein. Drilling fluid flows through the string of drilling pipe, into the upper sub and through the hollow pistons before leaving the shock absorber via the anvil. Each piston is comprised of a radially extending flange for sealing against the casing and a sleeve extending downwardly through a seating ring connected inside said casing. Pressure outside the casing feeds through holes in the casing to an annulus between the flange and the seating ring. The sleeve is held downward by a force equal to the pressure differential between the pressure inside the casing and the pressure outside the casing times the pressure differential area of the piston.

As downweight on the drill bit reaches a predetermined level, the anvil will slidably move upward inside the casing until it abuts the bottom piston. Further increases in the downweight will move the anvil and bottom piston into abutting engagement with the next adjacent piston. If the downweight on the drill bit is further increased to overcome the downward force on the second piston, the second piston will move upward with the first piston and anvil until the second piston abuts a third piston located thereabove. The procedure may be repeated for as many piston stages as are contained in the hydraulic shock absorber. A predetermined number of slidable pistons will be in abutting relationship depending upon the pressure differential, differential pressure areas of the respective pistons, and the downweight on the drill bit.

Assume for example that a predetermined downweight is being applied to a drill bit, and the anvil has reached its optimum position by successive abutments of a predetermined number of pistons. Thereafter, if the downweight is suddenly decreased by any action, such as the drill bit breaking through a hard formation, the number of pistons acting in successive abutting relationship against the anvil will be decreased by movement of the anvil in the lower sub. The vibration caused by the sudden change in operating conditions of the drill bit will be substantially attenuated by the hydraulic shock absorber.

It is important that sufficient flow exist from outside the casing to the annulus formed between each respective seating ring and flange, and from the center flow passage of the piston to the annulus formed below each respective seating ring so that each stage of the shock absorber will have a fast reaction time to allow fast response to changing conditions on the bottom of the hole.

DESCRIPTION OF THE PREFERRED EMBODIMENT

Figure 1:
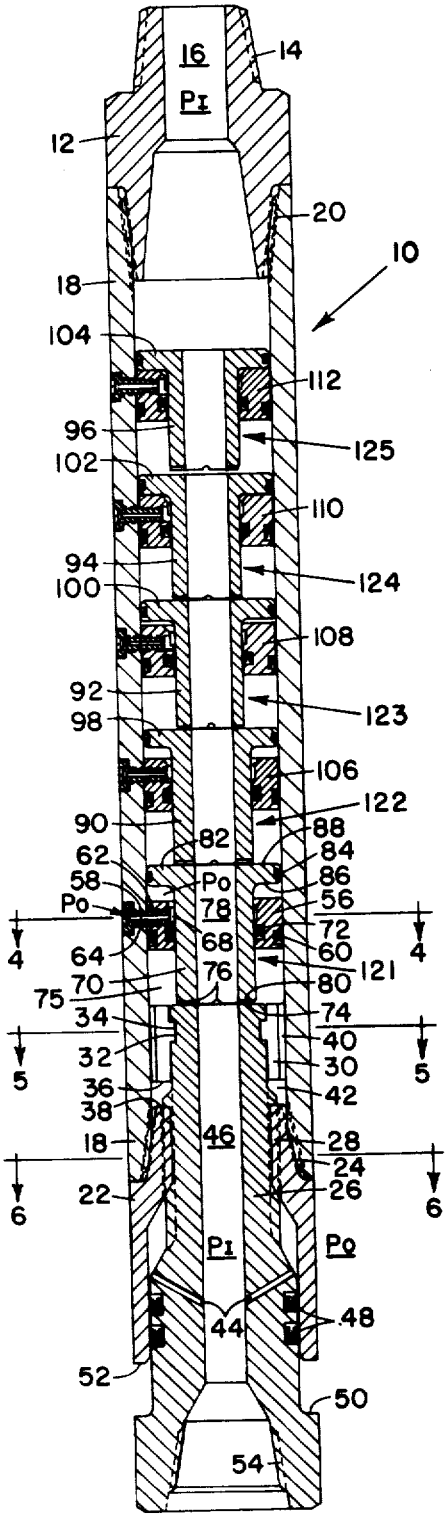
FIG. 1 is an elongated cross sectional view of the hydraulic shock absorber with the anvil partially retracted in the casing.

Referring now to FIG. 1 of the drawings, there is shown the hydraulic shock absorber represented generally by the reference numeral 10. The hydraulic shock absorber 10 has an upper sub 12 for connection in a string of drilling pipe by means of threads 14. A center flow passage 16 extends through the upper sub 12 for receiving drilling fluid from the string of drilling pipe. The upper sub 12 is connected to a casing 18 by means of threads 20. A lower sub 22 is connected to the bottom of casing 18 by means of threads 24.

Figure 5:
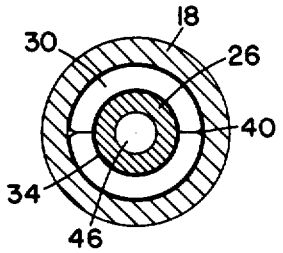
FIG. 5 is a cross sectional view of FIG. 1 along section lines 5—5.
Figure 6:
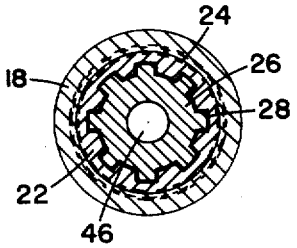
FIG. 6 is a cross sectional view of FIG. 1 along section lines 6—6.

Inside of lower sub 22 is mounted an anvil 26 by means of a spline connection 28 as can be seen in more detail in FIG. 6. By means of the spline connection 28, the anvil 26 is free to slide along the longitudinal axis of the hydraulic shock absorber 10 between limited stops. The lower stop of the anvil 26 is controlled by split ring 30. The split ring 30 is formed from two identical halves of a cylinder split along the longitudinal axis which halves are in an abutting relationship. The split ring 30 encircles the upper portion of anvil 26. An inwardly directed flange 32 of split ring connection 30 is received in undercut 34 of anvil 26. If anvil 26 were to move downward inside of lower sub 22 to its lowermost position, the bottom 36 of the split ring connection 30 would come to rest against the top 38 of the lower sub 22 to prevent further downward movement. V-slots 40 (See FIG. 5) extend the entire length of the split ring connection 30 to prevent drilling fluid from being trapped in annulus 42 thereby impeding longitudinal movement of the anvil 26. The construction of the split ring connection 30 can be seen in FIG. 5 in combination with FIG. 1.

Below the spline connection 28 are sloping cross bores 44 connecting to a center flow passage 46 of the anvil 26. The sloping cross bores 44 prevent fluid wash along the spline connection 28. Seals 48 between anvil 26 and lower sub 22 prevent the leakage of drilling fluid therebetween. The pressure outside the hydraulic shock absorber 10 (represented by the symbol $P_O$) is less than the pressure inside the hydraulic shock absorber (represented by the symbol $P_I$) by an amount substantially equal to the pressure drop across the drill bit (not shown). The anvil 26 is normally connected to a drill bit (not shown) by means of threads 54. Upward movement of the anvil 26, as will be subsequently described in more detail, is limited by the upper stop formed from an abutment of shoulder 50 with the bottom 52 of the lower sub 22.

Inside the casing 18 are located a plurality of hollow pistons, designated as first stage piston 121, second stage piston 122, third stage piston 123, fourth stage piston 124 and fifth stage piston 125. The pistons have similar components consisting of flanges respectively designated as 82, 98, 100, 102 and 104 and downwardly extending sleeves respectively designated as 70, 90, 92, 94 and 96. The sleeves are slideably received in seating rings designated respectively as 56, 106, 108, 110 and 112 which are connected to the casing by means of hollow screws 58 having passages 64 communicating through casing 18.

Figure 2:
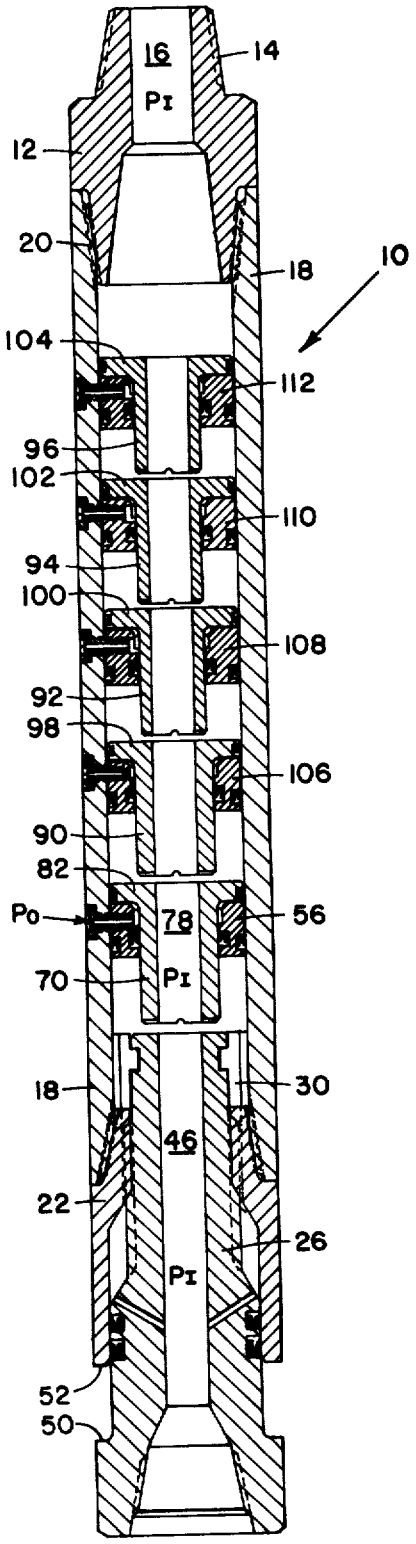
FIG. 2 is an elongated cross sectional view of the hydraulic shock absorber with the anvil fully extended from the casing.

In the unloaded condition as illustrated in FIG. 2, each of said pistons is separated from the adjacent piston by a finite distance in order that they will be sequentially activated upon upward movement of the anvil.

Figure 7:
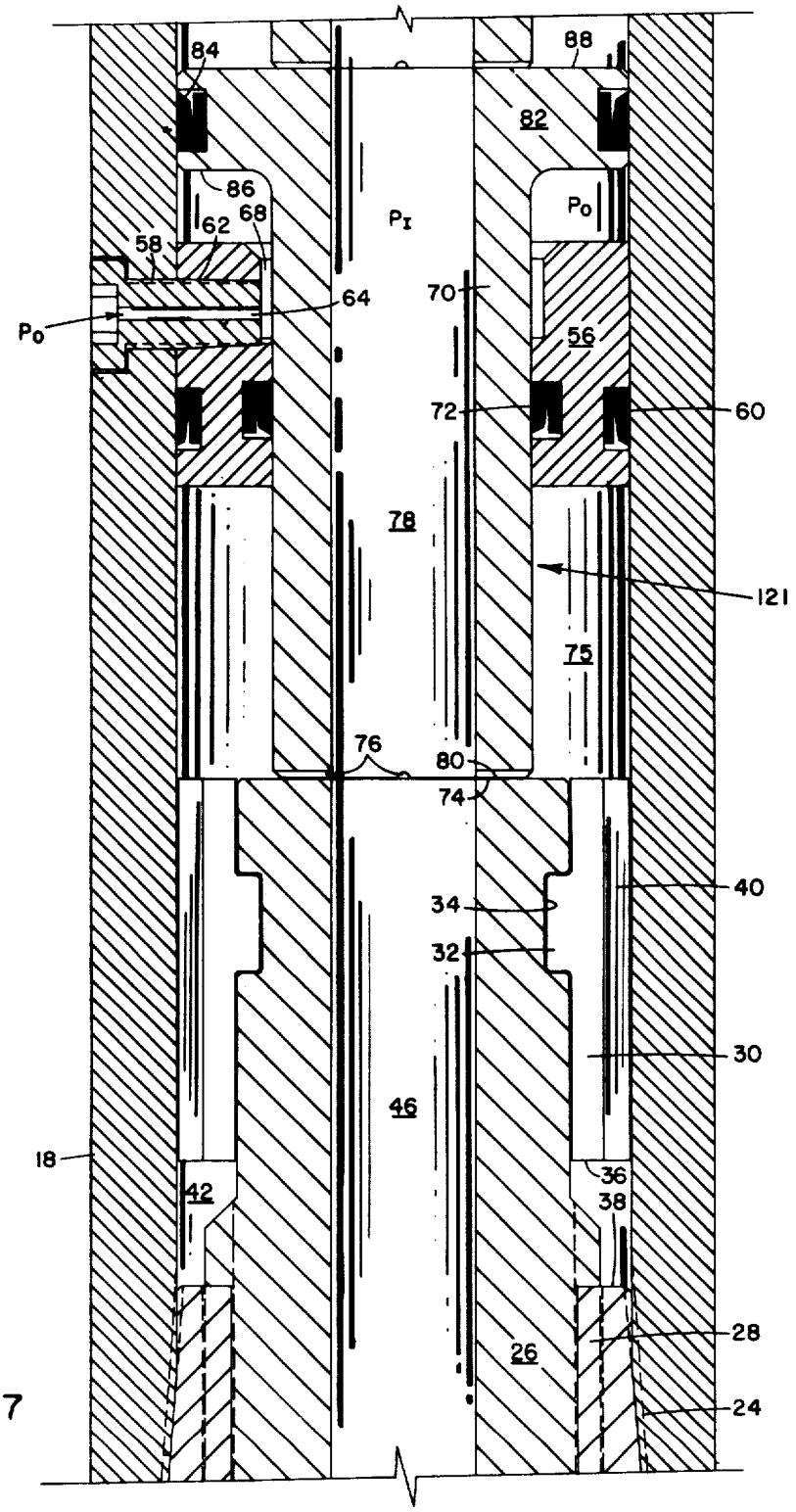
FIG. 7 is an enlarged view of a portion of the hydraulic shock absorber depicting the first stage piston.

Referring now to FIG. 7, a detailed description of the pistons and seating rings will be given for the first stage piston 121. The arrangement and function of each of the pistons is identical. It is also to be noted that in the preferred embodiment, the casing is described as a unitary member, however, it may be desirable to construct the casing in segments, each segment housing a single piston with the seating ring forming an integral part of the casing segment.

A seating ring 56 is held in position by hollow screws 58 above anvil 26. The seating ring 56 seals with casing 18 by means of seal 60. The screws 58 have a passage 64 communicating from outside the casing 18, to an annulus 68 formed between the seating ring 56 and sleeve 70 of first stage piston 121. The sleeve 70 is slidably received inside of the seating ring 56. The sleeve 70 is slidably sealed with the seating ring 56 by means of seal 72. The bottom 74 of sleeve 70 has a series of cross slots 76 to allow fluid pressure through sleeve flow passage 78 to act across the entire bottom 74 of the sleeve 70 and the top 80 of anvil 26. Also, cross slots 76 allow fluid to pass in and out of chamber 75.

The piston 121 has a radially extending flange 82 that slidably seals with casing 18 by means of seal 84. As can be seen from the drawings, the surface area 86 below the radially extending flange 82 is subject to pressure $P_O$ via annulus 68 and passage 64. The pressure $P_I$ is acting on the upper surface area 88 and bottom surface 74 of piston 121. The pressure $P_O$ is acting on the surface area 86. The net downward force acting on piston 121 is the pressure $P_I$ minus $P_O$ times surface area 86.

METHOD OF OPERATION

Referring now to FIG. 2 of the drawings, the hydraulic shock absorber 10, previously described in conjunction with FIG. 1, is shown with the anvil 26 in the fully extended position with the bottom 36 of the split ring connection 30 resting against the top 38 of the lower sub 22. The maximum distance is separating shoulder 50 from bottom 52 of lower sub 22. By referring to each successive stage above anvil 26, it can be seen that the pistons 121, 122, 123, 124, and 125 are in the full down position, therefore, each of the pistons has a net downward force thereon equal to $P_I$ minus $P_O$ times the pressure differential area of each respective piston, namely the area of surface 86. It should be understood that the primary differential area of each piston can be varied by varying the cross sectional area of the sleeve.

As a typical illustration concerning the use of the hydraulic shock absorber 10, assume that the pressure drop across the drill bit is approximately 850 psi, therefore, $P_I$ minus $P_O$ is approximately equal to 850 psi. If the effective area of the anvil 26, as defined by seals 48, is approximately 21.6 in. sq., the downward force caused by the pressure drop is equal to 850 psi times 21.6 in. sq., or 18,360 lbs. of force tending to move the anvil 26 to its lowermost position. Therefore, during normal drilling operations a total of 18,360 lbs. of downweight must be exerted on the drill bit to overcome the downward force on the anvil 26. Once the downweight exceeds 18,360 lbs., the anvil 26 will slide upward in the spline connection 28 until it abuts the bottom 74 of piston 121.

The piston 121 forms the first stage of the hydraulic shock absorber 10. Piston 121 is held down by a force equal to $P_I$ minus $P_O$ (850 lbs.) times the surface area 86 of the flange 82. Assume the surface area 86 is approximately equal to 11.4 in. sq. Then, the downward force acting on the first stage is equal to 850 lbs. times 11.4 in. sq. which equals 9,690 lbs. Once the downweight on the drill bit has increased by an additional 9,690 lbs. so that it now exceeds 28, 050 lbs., both the anvil 26 and the first stage will move upward until the first stage abuts the second stage.

Assuming the surface area below flange 98 of piston 122 is 11.4 in. sq., the downweight on the drill bit must increase by an additional 9,690 lbs. to a total that exceeds 37,740 lbs. downweight on the drill bit before any subsequent upward movement of the anvil 26 occurs. Any downweight in excess of 37,740 lbs. will move the anvil 26, the first stage and the second stage of the hydraulic shock absorber 10 upward until the second stage abuts piston 123.

Assume now that the surface area below flange 100 of sleeve 92 is approximately 12.5 in. sq., then the additional force necessary to raise the third stage is equal to 10,650 lbs. for a total downweight in excess of 48,365 lbs. When the downweight on the drill bit exceeds 48,365 lbs., the anvil 26 and the first, second and third stages will move upward until the third stage abuts the fourth stage piston 124.

Assuming that the effective surface area of both remaining stages are also 12.5 in. sq., then downweights of 58,990 lbs. and 69,615 lbs., respectively, will be required to displace these stages.

Figure 3:
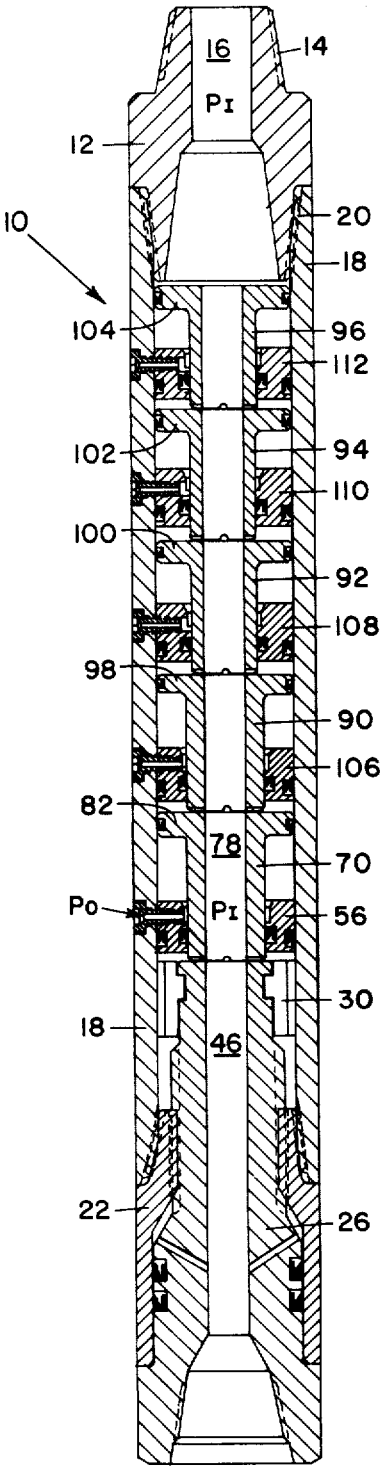
FIG. 3 is an elongated cross sectional view of the hydraulic shock absorber with the anvil fully retracted inside the casing.
Figure 4:
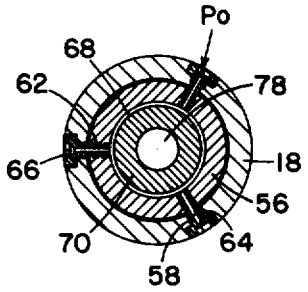
FIG. 4 is a cross sectional view of FIG. 1 along section lines 4—4.

Once the total design limitation of the hydraulic shock absorber 10 has been exceeded by the 69,615 lbs. downweight given in this illustration, the shoulder 50 of the anvil 26 will abut bottom 52 of lower sub 22. Any additional downweight will be transmitted directly through the casing 18 from the string of drilling pipe (not shown) to the drilling bit (not shown). A typical example of the hydraulic shock absorber 10 which has exceeded its design limitation is shown in FIG. 3 wherein each stage of the hydraulic shock absorber 10 has been raised from its respective seating block, and shoulder 50 of anvil 26 abuts bottom 52 of lower sub 22. FIG. 1 illustrates a typical operating condition wherein stages one, two and three have been raised from their respective seating blocks 56, 106 and 108. The third stage is abutting the bottom of the fourth stage; however, the additional downward force of the fourth stage has not been exceeded.

Due to change in the formations being drilled, the downweight on the drill bit is subject to rapid changes. The previously described stages of the hydraulic shock absorber 10, which have been described at typical operating pressures and downweights, will act to attenuate the shock effect of variations in the downweight on the drill bit. Otherwise, the shock effect would be reflected through the string of drilling pipe.

It will be obvious to one skilled in the art that the response rate of the shock absorber assembly is determined by the size of the flow passages 64 in hollow screws 58, and notches 76.

It should also be realized that the downward force exerted by each stage of the hydraulic shock absorber 10 may be varied by varying the pressure drop across the bit. Pressure drop across the bit can be varied by varying the flow rate at the surface or by a change in restriction to flow in the bit. A common method of further restricting the flow through the bit would be the insertion of a ball, commonly called a "frac ball", at the surface. The ball would flow through the string of drilling pipe and the hydraulic shock absorber 10 to the drilling bit and seat in one of a plurality of restricted passages in the drill bit. By restricting or stopping flow through one of the passages of the drill bit, the pressure drop across the drill bit is increased significantly. Since the force exerted by each stage is directly dependent upon the pressure drop across the drill bit, the force required to overcome the down force of each succeeding stage of the hydraulic shock absorber 10 has been directly increased.

I claim:

1. A method for absorbing the shocks in a rotary earth drill utilizing a drill-string and drilling fluid, comprising the steps of:

transmitting downweight from the drill-string and shocks on a rotary drilling bit engaged against the material being drilled to an anvil mounted with a drill-string; and sequentially transmitting the downweight and shocks from the anvil to a plurality of independently operating hydraulic pistons when downweight on said drill bit exceeds increasing predetermined amounts for each piston.

2. The method as set forth in claim 1, including the steps of:

communicating the drilling fluid within the drill string to a first pressure area of the anvil; and longitudinally moving said anvil upward relative to the drill string between lower and upper limits as the downweight increases.

3. The method as set forth in claim 2, including the steps of:

transmitting the downweight and shocks to the anvil opposing the force of the drilling fluid on the first pressure area.

4. The method as set forth in claim 1, including the step of:

longitudinally moving the anvil upward relative to the drill string to abut a first of said plurality of the pistons when the downweight exceeds a first predetermined amount.

5. The method as set forth in claim 4, including the steps of:

communicating the drilling fluid outside the drill string to a chamber having a predetermined volume formed by the first piston; and increasing the volume of the chamber in response to increasing of the drill string downweight.

6. The method as set forth in claim 4, including the step of:

longitudinally moving the first piston relative to the drill string to engage a second of said plurality of pistons when the downweight exceeds a second predetermined amount.

7. The method as set forth in claim 6, including the steps of:

communicating the drill fluid outside the drill-string to first and second chambers having predetermined volume limits formed by the first and second pistons, respectively; and increasing the volume of the first chamber to a predetermined limit and thereafter increasing the volume of the second chamber in response to increases of the drill-string downweight.

8. A method of absorbing the shocks in a rotary earth drill utilizing drill fluid; comprising the steps of:

conducting drilling fluid through a drill string and a plurality of independently operating hydraulic pistons and an anvil mounted with the drill string to a drill bit penetrating the earth;

communicating the drilling fluid within the drill string to first pressure areas on each piston and the anvil;

communicating the drilling fluid outside the drill string to a chamber, formed by each piston each chamber having predetermined volumes and each chamber having a second pressure area opposing the corresponding first pressure areas; and sequentially and independently increasing the volumes of the piston chambers as the downweight of the drill string increases predetermined amounts.

9. The method as set forth in claim 8 including the steps of:

sequentially abutting the anvil and a first of the plurality of pistons and thereafter abutting sequentially the other pistons of the plurality of the pistons as the predetermined volumes decrease to their respective limits as the downweight of the drill string increases the predetermined amounts.

* * * * *